US005498276A

United States Patent [19]

Luk

[11] Patent Number: 5,498,276

[45] Date of Patent: Mar. 12, 1996

[54] IRON-BASED POWDER COMPOSITIONS CONTAINING GREEN STRENGH ENHANCING LUBRICANTS

[75] Inventor: Sydney Luk, Lafayette Hill, Pa.

[73] Assignee: Hoeganaes Corporation, Riverton, N.J.

[21] Appl. No.: 306,209

[22] Filed: Sep. 14, 1994

[51] Int. Cl.[6] ..... B22F 1/00

[52] U.S. Cl. ..... 75/252; 75/231

[58] Field of Search ..... 75/231, 246, 252, 75/255

[56] References Cited

U.S. PATENT DOCUMENTS

| | | | |
|---|---|---|---|
| 3,154,514 | 10/1964 | Kelly | 524/375 |
| 3,297,571 | 1/1967 | Bonis | 75/230 |
| 3,307,924 | 3/1967 | Michael | 29/182.5 |
| 3,410,684 | 11/1968 | Printz | 419/2 |
| 3,470,019 | 9/1969 | Steele | 117/227 |
| 3,516,933 | 6/1970 | Andres et al. | 252/12 |
| 3,577,226 | 5/1971 | Elbert et al. | 428/566 |
| 3,836,355 | 9/1974 | Lindskog | 75/252 |
| 3,838,981 | 10/1974 | Foley et al. | 75/246 |

(List continued on next page.)

FOREIGN PATENT DOCUMENTS

| | | |
|---|---|---|
| 310115 | 4/1989 | European Pat. Off. . |
| 0329475 | 8/1989 | European Pat. Off. . |
| 48-15125 | 5/1973 | Japan . |
| 1-119605 | 5/1989 | Japan . |
| 43574 | 10/1967 | Switzerland . |
| 2149714 | 6/1985 | United Kingdom . |
| 2228744 | 9/1990 | United Kingdom . |
| WO85/01230 | 3/1985 | WIPO . |

OTHER PUBLICATIONS

Chemical Abstracts, vol. 102, No. 2, Jan. 14, 1985, Columbus, Ohio, USA, Nissan Motor Co. Ltd, "*Materials for Injections Molding,*" p. 292, col. 1, abstrtact–No. 11 329q & Jpn. Kokai Tokkyo Koho JP 59, 121,150 (84, 121, 150).

Chemical Abstracts, vol. 100, No. 20, May 14, 1984, Columbus, Oh, USA, Nissan Motor Co. Ltd., "*Injection Molding Materials,*" p. 272, col. 2, abstract–No. 160 951x & Jpn. Kokai Tokkyo Koho JP 58, 223, 662 (83,223,662).

Chemical Abstracts, vol. 114, No. 18, May 6, 1991, Columbus, Ohio, USA, Takayama T. et al., "*Sintering for Precision Structural Parts from Steel,*" p. 283, col. 2, abstract–No. 168 865g. & Jpn. Kokai Tokkyo Koho JP 02, 141, 502 (90,141, 502).

"*Pressing the Hard to Press Powders*" C. T. Waldo IBM Corp. (Jul. 1983).

"*Binders for Briquetting and Agglomeration*", Henry C. Messman, Proceedings of the 15th Biennial Conference, pp. 173–178 (Aug. 1977).

Browning, *Agglomeration: Growing Larger in Applications and Technology, Chemical Engineering,* Dec. 4, 1967, pp. 147–170.

Tengzelius et al., *Influence on Precision of PM Parts of Various Binder Additions to Poweder, Powder Mettalurgy,* 1985, vol. 28, No. 1, pp. 43–48.

Semel et al., *Properties of Parts Made from a Binder Treated 0.45*

Phosphorus Containing Iron Powder Blend, Progress in Metallurgy, 1987, vol. 43, p. 723.

Semel et al., *Statistical Process Control in Iron Powder Production and New Product Development,* SAE Technical Paper No. 880114, International Congress & Exposition, 1988.

Semel, *Properties of Parts Made from ANCORBOND® Processed Carbon Steel Poweder Mix (F–0008),* Modern Developments in Powder Metallurgy, 1988, vol. 21, p. 101.

Semel, *Properties of Parts Made from ANCORBOND® Processed Carbon–Nickel–Steel Powder Mix (FN00208),* Advances in Powder Metallurgy, vol. 1, pp. 9.

Tengzelius, et al. *Powder Mixes for Precision Components,* Edinburgh, Oct. 24–26, 1983.

F. J. Semel, "The Effects of a Decreased Nickel Content in an ANCORBOND® Processed FN–0208 Carbon–Nickel–Steel Powder Mix", Proceedings of the 1990 Powder Metal Conference, Pittsburgh, PA, Metal Powder Industries Federation.

Engstrom, U., "Glued Powder Mixes for Improved Tolerance Control" Proceedings of the 1986 International Powder Metals Conference, Dusseldorf, Germany, European Powder Metals Federation.

Sonobe, A. et al., "Properties of Mixed Powders Free from Segregation and Dusting", Proceedings of the 1989 Powder Metals Conference, San Diego, CA Metal Powder Industries Federation.

Hayami, T. et al., "Properties of Segregation–Less Mixed Powder" Proceedings of the 1990 Powder Metal Conference, Pittsburgh, PA, Metal Powder Industries Federation.

McDermott, M. J. "P/M Parts Fabrication Experience with ANCORBOND® (Binder Treated) Premixes" (1990).

Gosselin, F. et al., "Segregation–Free Blends: Processing Parameters and Product Properties", Proceedings of the 1990 World Conference on Powder Metallury, London, US European Powder Metals Association.

Handbook of Powder Metallurgy, Ed. Henery H. Hausner, Chemical Publishing Co., Inc. 126–143 (1973).

CARBOWAX® Polyethylene Glycols, Product Information Bulletin, 1986, Union Carbide Corporation.

Okabe et al., "A Study on Friction–Polymer Type Additives", Proc. of the JSLE Intl. Tribology Conference, 1985, Tokyo.

Masuko et al., "Anti–wear Properties of Hydroxy–carboxylic Acids with Straight Alkyl Chains", Triboloby Intl. (1988).

List of Trade Names and Manufacturers of Placticizers, Placticizers 288.

*Primary Examiner*—George Wyszomierski

*Attorney, Agent, or Firm*—Woodcock Washburn Kurtz Mackiewicz & Norris

[57] ABSTRACT

Metallurgical powder compositions are provided which contain a metal powder in admixture with a solid, particulate polyether lubricant. The incorporation of the polyether lubricant enhances the green strength properties of compacted parts made from the powder compositions, and generally reduces the ejection forces required to remove the compacted part from the die cavity.

24 Claims, No Drawings

U.S. PATENT DOCUMENTS

| | | | |
|---|---|---|---|
| 3,846,126 | 11/1975 | Foley et al. | 75/228 |
| 3,988,524 | 10/1976 | Dreyer et al. | 428/403 |
| 4,047,983 | 9/1977 | Falkowski et al. | 148/105 |
| 4,062,678 | 12/1977 | Dreyer et al. | 75/228 |
| 4,075,384 | 2/1978 | Suzuki et al. | 427/127 |
| 4,106,932 | 8/1978 | Blachford | 75/252 |
| 4,108,785 | 8/1978 | Sturwold | 252/56 R |
| 4,115,158 | 9/1978 | Reen | 148/100 |
| 4,116,906 | 9/1978 | Ishino et al. | 106/308 M |
| 4,123,266 | 10/1978 | Foley et al. | 75/246 |
| 4,181,525 | 1/1980 | Novinski | 75/255 |
| 4,190,441 | 2/1980 | Tengzelius et al. | 75/255 |
| 4,199,460 | 4/1980 | Sumrell et al. | 252/46.7 |
| 4,268,599 | 5/1981 | Russell | 106/308 M |
| 4,362,559 | 12/1982 | Perez et al. | 75/53 |
| 4,483,905 | 11/1984 | Engström | 428/570 |
| 4,491,559 | 1/1985 | Grab et al. | 419/36 |
| 4,502,982 | 3/1985 | Horie et al. | 524/440 |
| 4,504,441 | 3/1985 | Kuyper | 419/36 |
| 4,545,926 | 10/1985 | Fouts et al. | 252/511 |
| 4,634,627 | 1/1987 | Fujiki et al. | 428/900 |
| 4,676,831 | 6/1987 | Engström | 75/252 |
| 4,721,599 | 1/1988 | Nakamura | 419/23 |
| 4,735,734 | 4/1988 | Staub et al. | 252/29 |
| 4,834,800 | 5/1989 | Semel | 106/403 |
| 4,921,665 | 5/1990 | Klar et al. | 419/23 |
| 4,946,499 | 8/1990 | Sakuranda | 75/343 |
| 4,955,798 | 9/1990 | Museila et al. | 419/31 |
| 4,976,778 | 12/1990 | Berry et al. | 75/254 |
| 5,069,714 | 12/1991 | Gosselin | 75/252 |
| 5,098,942 | 3/1992 | Menke et al. | 524/314 |
| 5,108,493 | 4/1992 | Causton | 75/255 |
| 5,125,990 | 6/1992 | Iwasaki et al. | 148/302 |
| 5,256,185 | 10/1993 | Semel et al. | 75/255 |
| 5,290,336 | 3/1994 | Luk | 75/231 |
| 5,298,055 | 3/1994 | Semel et al. | 75/252 |

IRON-BASED POWDER COMPOSITIONS CONTAINING GREEN STRENGH ENHANCING LUBRICANTS

FIELD OF THE INVENTION

This invention relates to iron-based, metallurgical powder compositions, and more particularly, to powder compositions which include an improved solid lubricant for enhancing the green strength characteristics of resultant compacted parts.

BACKGROUND OF THE INVENTION

The powder metallurgy industry has developed metal-based powder compositions, generally iron-based powders, that can be processed into integral metal parts having various shapes and sizes for uses in various industries, including the automotive and electronics industries. One processing technique for producing the parts from the base powders is to charge the powder into a die cavity and compact the powder under high pressures. The resultant green compact is then removed from the die cavity and sintered to form the final part.

To avoid excessive wear on the die cavity, lubricants are commonly used during the compaction process. Lubricants can be generally classified into two groups: internal (dry) lubricants and external (spray) lubricants. The internal lubricants are admixed with the metal-based powder composition, and the external lubricants are sprayed onto the die cavity prior to compaction. Lubricants are used to reduce internal friction between particles during compaction, to permit easier ejection of the compact from the die cavity, to reduce die wear, and/or to allow more uniform compaction of the metal powder blend. Common lubricants include solids such as metallic stearates or synthetic waxes.

As will be recognized, most known internal lubricants reduce the green strength of the compact. It is believed that during compaction the internal lubricant is exuded between iron and/or alloying metal particles such that it fills the pore volume between the particles and interferes with particle-to-particle bonding. Indeed, some shapes cannot be pressed using known internal lubricants. Tall, thin-walled bushings, for example, require large amounts of internal lubricant to overcome die wall friction and reduce the required ejection force. Such levels of internal lubricant, however, typically reduce green strength to the point that the resulting compacts crumble upon ejection. Also, internal lubricants such as zinc stearate often adversely affect powder flow rate and apparent density, as well as green density of the compact, particularly at higher compaction pressures. Moreover, excessive amounts of internal lubricants can lead to compacts having poor dimensional integrity, and volatized lubricant can form soot on the heating elements of the sintering furnace. To avoid these problems, it is known to use an external spray lubricant rather than an internal lubricant. However, the use of external lubricants increases the compaction cycle time and leads to less uniform compaction.

Accordingly, there exists a need in the art for metallurgical powder compositions that can be readily compacted to strong green parts that are easily ejected from die cavities without the need for an external lubricant. One solution to this problem is to employ powder compositions such as those set forth in U.S. Pat. No. 5,290,336 to Luk, assigned to Hoeganaes Corporation. The U.S. Pat. No. 5,290,336 patent discloses the use of a polyether with a dibasic organic acid to both increase green strength properties and to act as a binding agent. These compositions are preferably prepared using a solvent for the dibasic organic acid, and such solvent preparation methods can increase the costs of manufacture. The compositions of the present invention are preferable to those disclosed in the U.S. Pat. No. 5,290,336 patent in that the dibasic organic acid is not required, and there is no need for a solvent-based blending process.

SUMMARY OF THE INVENTION

The present invention provides metallurgical powder compositions comprising a metal-based powder, optionally a particulate alloy powder for the metal-based powder, and an improved solid lubricant component. The improved solid lubricant component enhances one or more physical properties of the powder mixture such as flow, compressibility, and green strength. One benefit of the present invention is that metal-based powder compositions can be prepared in a solventless blending operation. These compositions can be compacted at relatively low pressures into parts having high green strengths. Since compacts made from the present powder compositions require less force for ejection from molds and dies, there is less wear and tear on tooling.

The improved solid lubricant component comprises a solid, particulate polyether, such as those compounds having more than one subunit of a formula:

$$-[O(CH_2)_q]-$$

wherein q is from about 1 to about 7. More preferred are solid, particulate polyethers having a formula:

$$H-[O(CH_2)_q]_n-OH$$

wherein q is from about 1 to about 7 and n is selected such that the polyether has a weight average molecular weight greater than 10,000. Preferably, q is 2 and n is selected such that the polyether has a weight average molecular weight from about 10,000 to about 4,000,000, more preferably about 20,000 to about 3,000,000, and even more preferably about 20,000 to about 300,000.

The metallurgical powder compositions can be prepared by admixing the metal-based powder, the solid lubricant component, and the optional alloying powder, using conventional blending techniques, provided that the polyether lubricant remains in the final mixture in particulate form. The metallurgical powder compositions can be compressed into compacts in a die and subsequently sintered according to standard powder metallurgy techniques.

DETAILED DESCRIPTION OF THE INVENTION

The present invention relates to improved metallurgical powder compositions, methods for the preparation of those compositions, and methods for using those compositions to make compacted parts. The powder compositions comprise a metal-based powder, preferably an iron-based metal powder, in admixture with an improved solid lubricant component that contains a solid polyether, in particulate form, having a weight average molecular weight between about 10,000 and about 4,000,000. It has been found that the use of the particulate polyether as lubricant for the metallurgical powder composition provides improved strength and ejection performance of the green compact while maintaining equivalent or superior compressibility relative to the use of other lubricants.

The metallurgical powder compositions of the present invention comprise metal powders of the kind generally used in the powder metallurgy industry, such as iron-based powders and nickel-based powders. The metal powders constitute a major portion of the metallurgical powder composition, and generally constitute at least about 80 weight percent, preferably at least about 90 weight percent, and more preferably at least about 95 weight percent of the metallurgical powder composition.

Examples of "iron-based" powders, as that term is used herein, are powders of substantially pure iron, powders of iron pre-alloyed with other elements (for example, steel-producing elements) that enhance the strength, hardenability, electromagnetic properties, or other desirable properties of the final product, and powders of iron to which such other elements have been diffusion bonded.

Substantially pure iron powders that can be used in the invention are powders of iron containing not more than about 1.0% by weight, preferably no more than about 0.5% by weight, of normal impurities. Examples of such highly compressible, metallurgical-grade iron powders are the ANCORSTEEL 1000 series of pure iron powders, e.g. 1000, 1000B, and 1000C, available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85–3.00 g/cm$^3$, typically 2.94 g/cm$^3$. Other iron powders that can be used in the invention are typical sponge iron powders, such as Hoeganaes' ANCOR MH-100 powder.

The iron-based powder can incorporate one or more alloying elements that enhance the mechanical or other properties of the final metal part. Such iron-based powders can be powders of iron, preferably substantially pure iron, that has been pre-alloyed with one or more such elements. The pre-alloyed powders can be prepared by making a melt of iron and the desired alloying elements, and then atomizing the melt, whereby the atomized droplets form the powder upon solidification.

Examples of alloying elements that can be pre-alloyed with the iron powder include, but are not limited to, molybdenum, manganese, magnesium, chromium, silicon, copper, nickel, gold, vanadium, columbium (niobium), graphite, phosphorus, aluminum, and combinations thereof. The amount of the alloying element or elements incorporated depends upon the properties desired in the final metal part. Pre-alloyed iron powders that incorporate such alloying elements are available from Hoeganaes Corp. as part of its ANCORSTEEL line of powders.

A further example of iron-based powders are diffusion-bonded iron-based powders which are particles of substantially pure iron that have a layer or coating of one or more other metals, such as steel-producing elements, diffused into their outer surfaces. Such commercially available powders include DISTALOY 4600A diffusion bonded powder from Hoeganaes Corporation, which contains about 1.8% nickel, about 0.55% molybdenum, and about 1.6% copper, and DISTALOY 4800A diffusion bonded powder from Hoeganaes Corporation, which contains about 4.05% nickel, about 0.55% molybdenum, and about 1.6% copper.

A preferred iron-based powder is of iron pre-alloyed with molybdenum (Mo). The powder is produced by atomizing a melt of substantially pure iron containing from about 0.5 to about 2.5 weight percent Mo. An example of such a powder is Hoeganaes' ANCORSTEEL 85HP steel powder, which contains about 0.85 weight percent Mo, less than about 0.4 weight percent, in total, of such other materials as manganese, chromium, silicon, copper, nickel, molybdenum or aluminum, and less than about 0.02 weight percent carbon. Another example of such a powder is Hoeganaes' ANCORSTEEL 4600V steel powder, which contains about 0.5–0.6 weight percent molybdenum, about 1.5–2.0 weight percent nickel, and about 0.1–0.25 weight percent manganese, and less than about 0.02 weight percent carbon.

Another pre-alloyed iron-based powder that can be used in the invention is disclosed in U.S. Pat. No. 5,108,493, entitled "Steel Powder Admixture Having Distinct Pre-alloyed Powder of Iron Alloys," which is herein incorporated in its entirety. This steel powder composition is an admixture of two different pre-alloyed iron-based powders, one being a pre-alloy of iron with 0.5–2.5 weight percent molybdenum, the other being a pre-alloy of iron with carbon and with at least about 25 weight percent of a transition element component, wherein this component comprises at least one element selected from the group consisting of chromium, manganese, vanadium, and columbium. The admixture is in proportions that provide at least about 0.05 weight percent of the transition element component to the steel powder composition. An example of such a powder is commercially available as Hoeganaes' ANCORSTEEL 41 AB steel powder, which contains about 0.85 weight percent molybdenum, about 1 weight percent nickel, about 0.9 weight percent manganese, about 0.75 weight percent chromium, and about 0.5 weight percent carbon.

Other iron-based powders that are useful in the practice of the invention are ferromagnetic powders. An example is a powder of iron pre-alloyed with small amounts of phosphorus.

The iron-based powders that are useful in the practice of the invention also include stainless steel powders. These stainless steel powders are commercially available in various grades in the Hoeganaes ANCOR® series, such as the ANCOR® 303L, 304L, 316L, 410L, 430L, 434L, and 409Cb powders.

The particles of iron or pre-alloyed iron can have a weight average particle size as small as one micron or below, or up to about 850–1,000 microns, but generally the particles will have a weight average particle size in the range of about 10–500 microns. Preferred are iron or pre-alloyed iron particles having a maximum weight average particle size up to about 350 microns; more preferably the particles will have a weight average particle size in the range of about 25–150 microns, and most preferably 80–150 microns.

The metal powder used in the present invention can also include nickel-based powders. Examples of "nickel-based" powders, as that term is used herein, are powders of substantially pure nickel, and powders of nickel pre-alloyed with other elements that enhance the strength, hardenability, electromagnetic properties, or other desirable properties of the final product. The nickel-based powders can be admixed with any of the alloying powders mentioned previously with respect to the iron-based powders. Examples of nickel-based powders include those commercially available as the Hoeganaes ANCORSPRAY® powders such as the N-70/30 Cu, N-80/20, and N-20 powders.

In accordance with the present invention, the metal powder is admixed with the solid lubricant component. This lubricant component comprises a solid, particulate polyether, such as those compounds having more than one subunit of a formula:

$$-[O(CH_2)_q]-$$

wherein q is from about 1 to about 7. Preferred are solid, particulate polyethers having a formula:

$$H-[O(CH_2)_q]_n-OH$$

wherein q is from about 1 to about 7 and n is selected such that the polyether has a weight average molecular weight greater than 10,000 based on rheological measurements. Preferably, q is 2 and n is selected such that the polyether has a weight average molecular weight from about 10,000 to about 4,000,000, more preferably from about 20,000 to about 3,000,000, and even more preferably from about 20,000 to about 300,000, as determined by gel permeation chromatography (GPC). One particularly preferred embodiment incorporates a polyether having a weight average molecular weight of about 100,000. The polyether is generally referred to as a polyethylene oxide when q is 2. The polyether is preferably substantially linear in structure and is an oriented polymer having a high degree of crystallinity, preferably as high as 95% crystallinity. It should burn cleanly in the sintering process to leave no ash. Preferred solid, particulate polyethers are the ethylene oxide derivatives generally disclosed in U.S. Pat. No. 3,154,514, in the name of Kelly. Particularly preferred are the CARBOWAX® 20M and POLYOX® N-10 resins, both of which are available from Union Carbide Corporation of Danbury, Conn.

The solid polyether is present in the composition in the form of discrete particles of the polyether. The weight average particle size of these particles is preferably between about 25 and 150 microns, more preferably between about 50 and about 150 microns, and even more preferably between about 70 and 110 microns. The weight average particle size distribution is preferably such that about 90% by weight of the polyether lubricant is below about 200 microns, preferably below about 175 microns, and more preferably below about 150 microns. The weight average particle size distribution is also preferably such that at least 90% by weight of the polyether particles are above about 3 microns, preferably above about 5 microns, and more preferably above about 10 microns.

The solid lubricant that is admixed with the metal powder in the practice of the invention is primarily designed to lower the ejection forces required for removing the compacted part from the die cavity. The incorporation of the solid, particulate polyether lubricant of this invention has been found to greatly improve the green strength of the compacted part, while also lowering these ejection forces. The metal-based powder compositions can contain the solid, particulate polyether lubricant of the invention as the sole internal lubricant component, or the compositions can additionally contain other, traditional internal lubricants as well. Examples of such other lubricants include stearate compounds, such as lithium, zinc, manganese, and calcium stearates commercially available from Witco Corp.; waxes such as ethylene bis-stearamides and polyolefins commercially available from Shamrock Technologies, Inc.; mixtures of zinc and lithium stearates commercially available from Alcan Powders & Pigments as Ferrolube M, and mixtures of ethylene bis-stearamides with metal stearates such as Witco ZB-90. It has been found that the beneficial green strength improvements resulting from the incorporation of the solid, particulate polyether compound as part of the solid lubricant component of the powder composition are generally proportional to the amount of the polyether relative to any other internal lubricants. Thus, it is preferred that the polyether generally constitute at least about 10%, preferably at least about 30%, more preferably at least about 50%, and even more preferably at least about 75%, by weight of the solid, internal lubricant present in the metallurgical composition. In most preferred embodiments, the solid particulate lubricant of the invention is 90–100% by weight of the lubricant present in the composition.

The solid lubricant is generally blended into the metallurgical powder composition in a minor amount, and generally in an amount of from about 0.05 to about 10 percent by weight. Preferably, the solid lubricant constitutes about 0.3–5%, more preferably about 0.5–2.5%, and even more preferably about 0.7–2%, by weight of the powder composition.

In certain embodiments, the powder composition also comprises a plasticizer as a portion of the solid lubricant component. Representative plasticizers are generally disclosed by R. Gachter and H. Muller, eds., Plastics Additives Handbook (1987) at, for example, pages 270–281 and 288–295. These include alkyl, alkenyl, or aryl esters wherein the alkyl, alkenyl, and aryl moieties have from about 1 to about 10 carbon atoms, from about 1 to about 10 carbon atoms, from about 6 to about 30 carbon atoms, respectively, phthalic acid, phosphoric acid, and dibasic acid. Preferred esters are alkyl esters, such as di-2-ethylhexyl phthalate (DOP), di-iso-nonyl phthalate (DINP), dibutyl phthalate (DBP), trixylenyl phosphate (TCP), and di-2-ethylhexyl adipate (DOA). DBP and DOP are particularly preferred plasticizers. The plasticizers can be incorporated into the metallurgical powder compositions in an amount of from about 0.1 to about 25 percent of the weight of the solid lubricant component.

The metallurgical powder compositions of the present invention can also include a minor amount of an alloying powder. As used herein, "alloying powders" refers to materials that are capable of alloying with the iron-based or nickel-based materials upon sintering. The alloying powders that can be admixed with metal powders of the kind described above are those known in the metallurgical arts to enhance the strength, hardenability, electromagnetic properties, or other desirable properties of the final sintered product. Steel-producing elements are among the best known of these materials. Specific examples of alloying materials include, but are not limited to, elemental molybdenum, manganese, chromium, silicon, copper, nickel, tin, vanadium, columbium (niobium), metallurgical carbon (graphite), phosphorus, aluminum, sulfur, and combinations thereof. Other suitable alloying materials are binary alloys of copper with tin or phosphorus; ferro-alloys of manganese, chromium, boron, phosphorus, or silicon; low-melting ternary and quaternary eutectics of carbon and two or three of iron, vanadium, manganese, chromium, and molybdenum; carbides of tungsten or silicon; silicon nitride; and sulfides of manganese or molybdenum. The alloying powders are in the form of particles that are generally of finer size than the particles of metal powder with which they are admixed. The alloying particles generally have a weight average particle size below about 100 microns, preferably below about 75 microns, more preferably below about 30 microns, and most preferably in the range of about 5–20 microns. The amount of alloying powder present in the composition will depend on the properties desired of the final sintered part. Generally the amount will be minor, up to about 5% by weight of the total powder composition weight, although as much as 10–15% by weight can be present for certain specialized powders. A preferred range suitable for most applications is about 0.25–4.0% by weight.

The components of the metallurgical powder compositions of the invention can be prepared following conventional powder metallurgy techniques in a manner that retains the polyether lubricant in particulate form in the final mixture. Generally, the metal powder, solid lubricant, and optional alloying powder are admixed together using a conventional powder metallurgy techniques, such as the use of a double cone blender. The blended powder composition is then ready for use.

In one embodiment, where alloying powder is admixed within the composition, the composition can be treated with a binder to decrease dusting and to reduce segregation. The description of useful binders, and methods for their incorporation into a powder composition, are set forth in U.S. Pat. Nos. 4,483,905 and 4,834,.800, both of which are incorporated herein in their entireties. It is preferred that the solvent used to apply any such binders be selected from that group of solvents in which the polyether lubricant is not soluble such that the polyether remains as a particulate lubricant after removal of the solvent. Typical solvents include toluene, acetone, ethyl acetate, ethanol, butanol, ethylene glycol, and propylene glycol, among others. In another embodiment, following the teachings of the U.S. Pat. Nos. 4,483,905 and 4,834,800 patents, the metal-based powder and the alloying powder are admixed first, then the binder is applied in a solvent solution and the solvent is evaporated. The lubricant component of the present invention can then be admixed to the pre-bonded powder composition.

EXAMPLES

The following examples, which are not intended to be limiting, present certain embodiments and advantages of the present invention. Unless otherwise indicated, any percentages are on a weight basis.

In each of the examples, the powders that constitute the powder composition were mixed in standard laboratory bottle-mixing equipment for about 20–30 minutes.

The powder compositions were then compacted into green bars in a die at the pressure indicated, followed by sintering in a dissociated ammonia atmosphere for about 30 minutes at temperatures of about 1120° C. (2050° F.).

Physical properties of powder mixtures and of the green and sintered bars were determined generally in accordance with the following test methods and formulas:

| Property | Test Method |
|---|---|
| Apparent Density (g/cc) | ASTM B212-76 |
| Dimensional change (%) | ASTM B610-76 |
| Flow (sec/50 g) | ASTM B213-77 |
| Green Density (g/cc) | ASTM B331-76 |
| Green Strength (psi) | ASTM B312-76 |
| Hardness ($R_B$) | ASTM E18-84 |
| Sintered Density (g/cc) | ASTM B331-76 |

$$\text{Green Expansion G.E. (\%)} = \frac{100[(\text{green bar length}) - (\text{die length})]}{\text{die length}}$$

Strip pressure measures the static friction that must be overcome to initiate ejection of a compacted part from a die. It was calculated as the quotient of the load needed to start the ejection over the cross-sectional area of the part that is in contact with the die surface, and is reported in units of psi.

Slide pressure is a measure of the kinetic friction that must be overcome to continue the ejection of the part from the die cavity; it is calculated as the quotient of the average load observed as the part traverses the distance from the point of compaction to the mouth of the die, divided by the surface area of the part, and is reported in units of psi.

Example 1

A comparison of a polyethylene oxide lubricant of the present invention to a conventional wax lubricant was made to determine the effects of the polyethylene oxide lubricant on the various properties of the compacted part. A reference powder mixture, Mix REF, was prepared containing 96.26% wt. Hoeganaes ANCORSTEEL 1000B iron powder, 0.64% wt. graphite powder (grade 3203HS, Ashbury Graphite Mill, Ashbury, N.J.), 2% wt. copper powder (Alcan grade 8081), 0.35% wt. MnS (Hoganäs, Sweden), and 0.75% wt. lubricant (Acrawax from Witco Chemical). The test mix, Mix A, was the same as the reference powder mixture, except that the Acrawax lubricant was replaced by 0.75% wt. polyethylene oxide having a weight average molecular weight of about 100,000 (POLYOX N10, Union Carbide).

The powder properties for the two mixes are shown in Table 1.1. The flowability of the powder composition containing the polyethylene oxide lubricant is improved, while the apparent density is lower.

TABLE 1.1

| POWDER PROPERTIES | MIX REF. | MIX A |
|---|---|---|
| A.D. | 3.07 | 2.94 |
| FLOW | 35.0 | 27.0 |

The compaction properties of the green bars are shown in Table 1.2 for compaction pressures of 20, 35, and 50 tons per square inch (tsi). Significantly, the green strength of the bar has increased from about 1–2.5 times due to the replacement of the wax lubricant with the polyethylene oxide lubricant, while the green density is maintained or increased (particularly at higher compaction pressures). The stripping and sliding pressures are significantly reduced due to the replacement of the wax lubricant with the polyethylene oxide lubricant. The incorporation of the polyethylene oxide lubricant thus results in a powder composition that can be compacted into parts having significantly higher green strengths and green densities that are also easier to remove from the die as shown by the lower ejection forces. The incorporation of the polyethylene oxide lubricant therefore improved both the green properties and the ejection properties of the compacted parts, and is thus a superior lubricant in comparison to the conventional wax lubricant.

TABLE 1.2

| GREEN PROPERTIES | MIX REF. | MIX A |
|---|---|---|
| BAR COMPACTED AT 20 TSI | | |
| GREEN DENSITY | 6.36 | 6.38 |
| GREEN STRENGTH | 1505 | 3787 |
| GREEN EXPANSION | 0.04 | 0.07 |
| STRIPPING PRESSURE | 2785 | 1260 |
| SLIDING PRESSURE | 1846 | 761 |
| BAR COMPACTED AT 35 TSI | | |
| GREEN DENSITY | 6.97 | 7.01 |
| GREEN STRENGTH | 2683 | 6816 |
| GREEN EXPANSION | 0.09 | 0.12 |
| STRIPPING PRESSURE | 3535 | 2293 |
| SLIDING PRESSURE | 1447 | 990 |

TABLE 1.2-continued

| GREEN PROPERTIES | MIX REF. | MIX A |
|---|---|---|
| BAR COMPACTED AT 50 TSI | | |
| GREEN DENSITY | 7.19 | 7.24 |
| GREEN STRENGTH | 2598 | 7016 |
| GREEN EXPANSION | 0.18 | 0.16 |
| STRIPPING PRESSURE | 3521 | 3045 |
| SLIDING PRESSURE | 1138 | 757 |

The sintered properties of the test bars compacted at 50 tsi are shown in Table 1.3.

TABLE 1.3

| SINTERED PROPERTIES | MIX REF. | MIX A |
|---|---|---|
| GREEN DENSITY | 7.18 | 7.22 |
| SINTERED DENSITY | 7.04 | 7.05 |
| DIMENSIONAL CHANGE | 0.45 | 0.59 |
| CARBON | 0.58 | 0.57 |
| OXYGEN | 0.043 | 0.050 |

Example 2

Tests were conducted to determine the effect of the amount of polyethylene oxide lubricant admixed into the powder composition. Test mixes were prepared in a similar fashion to mix A of Example 1, however the amount of the polyethylene oxide lubricant was reduced to 0.25% wt. in Mix B, and to 0.5% wt. in Mix C. The amounts of the various other powders in the mixture were increased proportionally.

The powder properties for the three mixes are shown in Table 2.1. The flowability and apparent density of the powder compositions remained fairly constant.

TABLE 2.1

| | MIX B | MIX C | MIX A |
|---|---|---|---|
| A.D. | 2.96 | 2.98 | 2.94 |
| FLOW | 26.43 | 25.81 | 27.0 |

The compaction properties of the green bars are shown in Table 2.2 for compaction pressures of 20, 35, and 50 tsi. Significantly, the improved green strength of the bars with the polyethylene oxide lubricant compared to the conventional wax lubricant is still shown for addition rates as low as 0.25%. The ejection forces were generally higher for the lower amounts of lubricant addition, as expected. The incorporation of the polyethylene oxide lubricant, at even low addition amounts, thus resulted in powder compositions that were compacted into parts having significantly higher green strengths.

TABLE 2.2

| | MIX B | MIX C | MIX A |
|---|---|---|---|
| BAR COMPACTED AT 20 TSI | | | |
| GREEN DENSITY | 6.29 | 6.31 | 6.38 |
| GREEN STRENGTH | 2724 | 2918 | 3787 |
| GREEN EXPANSION | 0.07 | 0.08 | 0.07 |
| STRIPPING PRESSURE | 2191 | 1874 | 1260 |
| SLIDING PRESSURE | 559 | 512 | 761 |

TABLE 2.2-continued

| | MIX B | MIX C | MIX A |
|---|---|---|---|
| BAR COMPACTED AT 35 TSI | | | |
| GREEN DENSITY | 6.98 | 7.00 | 7.01 |
| GREEN STRENGTH | 5512 | 5889 | 6816 |
| GREEN EXPANSION | 0.10 | 0.12 | 0.12 |
| STRIPPING PRESSURE | 4380 | 3777 | 2293 |
| SLIDING PRESSURE | 946 | 791 | 990 |
| BAR COMPACTED AT 50 TSI | | | |
| GREEN DENSITY | 7.29 | 7.28 | 7.24 |
| GREEN STRENGTH | 7145 | 6983 | 7016 |
| GREEN EXPANSION | 0.15 | 0.15 | 0.16 |
| STRIPPING PRESSURE | 5261 | 4003 | 3045 |
| SLIDING PRESSURE | 1113 | 895 | 757 |

The sintered properties of the test bars compacted at 50 tsi are shown in Table 2.3.

TABLE 2.3

| SINTERED PROPERTIES AT 50 TSI | | | |
|---|---|---|---|
| PROPERTY | MIX C | MIX B | MIX A |
| GREEN DENSITY | 7.29 | 7.26 | 7.22 |
| SINTERED DENSITY | 7.15 | 7.11 | 7.05 |
| DIMENSIONAL CHANGE | 0.55 | 0.53 | 0.59 |

Example 3

Tests were conducted to study the effect of varying the weight average molecular weight of the polyethylene oxide lubricant. The POLYOX N10 polyethylene oxide lubricant in Mix A of Example 1 was replaced with an equal amount of a polyethylene oxide having a weight average molecular weight of 20,000 (CARBOWAX® 20M, Dow) in Mix D, an equal amount of a polyethylene oxide having a weight average molecular weight of 400,000 (WSR 301, Union Carbide). in Mix E, and an equal amount of a polyethylene oxide having a weight average molecular weight of 4,000,000 (WSRN 3000, Union Carbide) in Mix F.

The powder properties for the four mixes are shown in Table 3.1. The flowability and apparent density of the powder compositions remained fairly constant.

TABLE 3.1

| | MIX D | MIX A | MIX E | MIX F |
|---|---|---|---|---|
| A.D. | 2.90 | 2.94 | 2.89 | 2.92 |
| FLOW | 27.15 | 27.0 | 26.97 | 26.83 |

The compaction properties of the green bars are shown in Table 3.2 for compaction pressures of 20, 35, and 50 tsi. Significantly, the improved green strength of the bars with the polyethylene oxide lubricant compared to the conventional wax lubricant is still shown for the different molecular weight polyethylene oxide lubricants. The ejection forces were all lower for the polyethylene oxide lubricants in comparison to the conventional wax lubricant (Mix REF), however this disparity was not as great with respect to the stripping pressure at the higher compaction pressures. The green density for the test bars is significantly lowered when the molecular weight of the polyethylene oxide was increased to 400,000 and 4,000,000, thus indicating that these lubricants interfere with the compressibility of the powder composition. Optimum properties appear to be obtained with the use of a polyethylene oxide having a molecular weight of about 100,000, although the incorporation of all of the polyethylene oxide lubricants resulted in powder compositions that were compacted into parts having significantly higher green strengths.

TABLE 3.2

| GREEN PROPERTIES | MIX D | MIX A | MIX E | MIX F |
|---|---|---|---|---|
| BAR COMPACTED AT 20 TSI | | | | |
| GREEN DENSITY | 6.32 | 6.38 | 6.27 | 6.25 |
| GREEN STRENGTH | 2824 | 3787 | 2687 | 2269 |
| GREEN EXPANSION | 0.06 | 0.07 | 0.08 | 0.09 |
| STRIPPING PRESSURE | 2026 | 1260 | 1659 | 1609 |
| SLIDING PRESSURE | 428 | 761 | 434 | 485 |
| BAR COMPACTED AT 35 TSI | | | | |
| GREEN DENSITY | 7.00 | 7.01 | 6.85 | 6.84 |
| GREEN STRENGTH | 5381 | 6816 | 4230 | 3742 |
| GREEN EXPANSION | 0.11 | 0.12 | 0.14 | 0.15 |
| STRIPPING PRESSURE | 3156 | 2293 | 2700 | 2576 |
| SLIDING PRESSURE | 703 | 990 | 706 | 754 |
| BAR COMPACTED AT 50 TSI | | | | |
| GREEN DENSITY | 7.24 | 7.24 | 7.06 | 7.09 |
| GREEN STRENGTH | 6410 | 7016 | 5112 | 4557 |
| GREEN EXPANSION | 0.16 | 0.16 | 0.19 | 0.20 |
| STRIPPING PRESSURE | 2712 | 3045 | 3279 | 3512 |
| SLIDING PRESSURE | 763 | 757 | 847 | 893 |

Example 4

Tests were conducted to determine the effects of replacing a portion of the polyethylene oxide lubricant with a synthetic wax lubricant. A powder mixture, Mix G, was prepared having the same composition as that of Mix A in Example 1, except that the 0.75% wt. polyethylene oxide lubricant was replaced by a lubricant of 0.4% wt. of the polyethylene oxide lubricant (POLYOX® N10) and 0.35% wt. synthetic wax lubricant (FERROLUBE, Blancford Corp.).

The powder properties for the three mixes are shown in Table 4.1. The flowability and apparent density of the powder compositions remained fairly constant.

TABLE 4.1

| | MIX G | MIX A |
|---|---|---|
| A.D. | 3.0 | 2.94 |
| FLOW | 27 | 27.0 |

The compaction properties of the green bars are shown in Table 4.2 for compaction pressures of 20, 35, and 50 tsi. The incorporation of the synthetic wax lubricant lowered the green strength for the test bars, however the green strength was still improved in comparison to the reference mix (Mix REF) of Example 1. The ejection forces were also lower in comparison to those found for the reference mix. Thus, the beneficial improvement to the green strength of the compacted parts from the incorporation of the polyethylene oxide lubricant is still present if that lubricant constitutes only a portion of the overall solid, internal lubricant.

TABLE 4.2

| GREEN PROPERTIES | MIX G | MIX A |
|---|---|---|
| BAR COMPACTED AT 20 TSI | | |
| GREEN DENSITY | 6.43 | 6.38 |
| GREEN STRENGTH | 1880 | 3787 |
| GREEN EXPANSION | 0.05 | 0.07 |
| STRIPPING PRESSURE | 1384 | 1260 |
| SLIDING PRESSURE | 858 | 761 |
| BAR COMPACTED AT 35 TSI | | |
| GREEN DENSITY | 7.02 | 7.01 |
| GREEN STRENGTH | 3478 | 6816 |
| GREEN EXPANSION | 0.11 | 0.12 |
| STRIPPING PRESSURE | 2266 | 2293 |
| SLIDING PRESSURE | 898 | 990 |
| BAR COMPACTED AT 50 TSI | | |
| GREEN DENSITY | 7.23 | 7.24 |
| GREEN STRENGTH | 3582 | 7016 |
| GREEN EXPANSION | 0.15 | 0.16 |
| STRIPPING PRESSURE | 2847 | 3045 |
| SLIDING PRESSURE | 624 | 757 |

The sintered properties of the test bars compacted at 50 tsi are shown in Table 4.3.

TABLE 4.3

| SINTERED PROPERTIES | MIX G | MIX A |
|---|---|---|
| GREEN DENSITY | 7.20 | 7.22 |
| SINTERED DENSITY | 7.06 | 7.05 |
| DIMENSIONAL CHANGE | 0.55 | 0.59 |

Example 5

Tests were conducted to determine the effect of the polyethylene oxide lubricant in powder compositions containing a stainless steel powder. Powder mixes were prepared as shown in Table 5.1.

TABLE 5.1

| MIX | SS1 | SS2 | SS3 | SS4 | SS5 |
|---|---|---|---|---|---|
| STAINLESS POWDER[1] | 98.75 | 98.75 | 99.0 | 99.25 | 99.25 |
| LUBRICANT[2] | 1.25 | 1.25 | 1.0 | 0.75 | 0.75 |

[1]Stainless steel powder was Hoeganaes 410L powder for mixes SS1, SS2, and SS3 and was Hoeganaes 316L powder for mixes SS4 and SS5

[2]Lubricant powder was lithium stearate (Witco Corp.) for mixes SS1 and SS4, and was polyethylene oxide (POLYOX ® N-10) for mixes SS2, SS3, and SS5.

The powder properties for the mixes are shown in Table 5.2. The flowability of the stainless powder mixes is improved significantly by replacing the conventional lithium stearate lubricant with the polyethylene oxide lubricant.

TABLE 5.2

| POWDER PROPERTIES | MIX SS1 | MIX SS2 | MIX SS3 | MIX SS4 | MIX SS5 |
|---|---|---|---|---|---|
| A.D. | 2.96 | 2.67 | 2.71 | 3.03 | 2.67 |
| FLOW | No Flow | 26.95 | 26.1 | 48.70 | 27.53 |

The compaction properties of the green bars are shown in Table 5.3 for compaction pressures of 40 and 50 tsi. Again, the green strength of the test bars was significantly improved, and the ejection forces were generally maintained or lowered, by replacing the conventional lubricant with the polyethylene oxide lubricant.

TABLE 5.3

| GREEN PROPERTIES | MIX SS1 | MIX SS2 | MIX SS3 | MIX SS4 | MIX SS5 |
|---|---|---|---|---|---|
| BAR COMPACTED AT 40 TSI | | | | | |
| GREEN DENSITY | 6.59 | 6.17 | 6.13 | — | — |
| GREEN STRENGTH | 1601 | 4891 | 4450 | — | — |
| GREEN EXPANSION | 0.15 | 0.14 | 0.14 | — | — |
| STRIPPING PRESSURE | 3376 | 3397 | 3400 | — | — |
| SLIDING PRESSURE | 1556 | 1141 | 1030 | — | — |
| BAR COMPACTED AT 50 TSI | | | | | |
| GREEN DENSITY | 6.50 | 6.47 | 6.43 | 6.82 | 6.75 |
| GREEN STRENGTH | 2171 | 6598 | 5700 | 1977 | 6316 |
| GREEN EXPANSION | 0.15 | 0.15 | 0.14 | 0.19 | 0.13 |
| STRIPPING PRESSURE | 4259 | 4168 | 4300 | 3416 | 3509 |
| SLIDING PRESSURE | 2649 | 2102 | 2070 | 2499 | 2005 |

The sintered properties of the test bars compacted at 50 tsi are shown in Table 5.4.

TABLE 5.4

| SINTERED PROPERTIES | MIX SS1 | MIX SS2 | MIX SS3 |
|---|---|---|---|
| GREEN DENSITY | 6.52 | 6.49 | 6.46 |
| SINTERED DENSITY | 6.58 | 6.48 | 6.48 |
| DIMENSIONAL CHANGE | −0.38 | −0.21 | −0.27 |
| HARNESS $H_B$ | 97 | 95 | 95 |

What is claimed is:

1. An improved metallurgical powder composition, comprising:

(a) a major amount of a metal-based powder having a weight average particle size in the range of about 25–350 microns; and (b) a minor amount of a solid compaction lubricant comprising at least about 10 percent by weight of a solid, particulate polyether having the formula:

$$H—[O(CH_2)_q]_n—OH$$

where q is from about 1 to about 7, and n is selected such that the polyether has a weight average molecular weight between about 10,000 and about 4,000,000, wherein said polyether has a weight average particle size between about 25 and 150 microns.

2. The metallurgical powder composition of claim 1 wherein said polyether comprises polyethylene oxide present in an amount of at least 10 percent by weight of said solid lubricant.

3. The metallurgical powder composition of claim 2 wherein said metal-based powder is an iron-based powder or a nickel-based powder.

4. The metallurgical powder composition of claim 3 wherein said solid lubricant is present in an amount of from about 0.3 to about 10 percent by weight of said powder composition.

5. The metallurgical powder composition of claim 4 wherein said polyethylene oxide is present in an amount of at least 30% by weight of said solid lubricant.

6. The metallurgical powder composition of claim 5 wherein said polyethylene oxide has a weight average molecular weight between about 20,000 and about 3,000,000.

7. The metallurgical powder composition of claim 5 wherein said polyethylene oxide has a weight average molecular weight between about 20,000 and about 300,000.

8. The metallurgical powder composition of claim 7 wherein said metal-based powder is an iron-based powder.

9. The metallurgical powder composition of claim 7 wherein said polyethylene oxide has a particle size distribution such that at least 90% wt. of the polyethylene oxide is above about 10 microns and the weight average particle size of the polethylene oxide is between about 25 and 150 microns.

10. The metallurgical powder composition of claim 9 wherein the polyethylene oxide has a particle size distribution such that at least 90% by weight of the polyethylene oxide has a particle size below about 150 microns.

11. The metallurgical powder composition of claim 5 wherein said polyethylene oxide has a particle size distribution such that at least 90% wt. of the polyethylene oxide is above about 10 microns and the weight average particle size of the polyethylene oxide is between about 25 and 150 microns.

12. The metallurgical powder composition of claim 11 wherein the polyethylene oxide has a particle size distribution such that at least 90% by weight of the polyethylene oxide has a particle size below about 150 microns.

13. The metallurgical powder composition of claim 4 wherein said polyethylene oxide constitutes at least 50% by weight of said solid lubricant.

14. The metallurgical powder composition of claim 13 wherein said polyethylene oxide has a weight average molecular weight of between about 20,000 and about 300,000.

15. The metallurgical powder composition of claim 14 wherein said polyethylene oxide has a particle size distribution such that at least 90% wt. of the polyethylene oxide is above about 10 microns, at least 90% by weight of the polyethylene oxide has a particle size below about 150 microns, and the weight average particle size of the polyethylene oxide is between about 25 and 150 microns.

16. The metallurgical powder composition of claim 13 wherein said polyethylene oxide has a weight average molecular weight of between about 20,000 and about 100,000.

17. The metallurgical powder composition of claim 16 wherein said metal-based powder is an iron-based powder.

18. The metallurgical powder composition of claim 17 wherein said polyethylene oxide constitutes at least 90% by weight of the solid lubricant and has a weight average particle size of about 25–150 microns.

19. The metallurgical powder composition of claim 18 further comprising a minor amount of an alloying powder.

20. An improved metallurgical powder composition, comprising:

(a) a major amount of an iron-based powder having a weight average particle size in the range of about 25–150 microns; and (b) from about 0.05 to about 5 weight percent of a solid, particulate polyether having the formula:

$$H—[O(CH_2)_q]_n—OH$$

where q is from about 1 to about 7, and n is selected such that the polyether has a weight average molecular weight between about 10,000 and about 4,000,000, wherein said polyether has a weight average particle size between about 25 and 150 microns.

21. The metallurgical powder composition of claim 20 wherein said polyether is polyethylene oxide having a weight average molecular weight of from about 10,000 to about 300,000.

22. The metallurgical powder composition of claim 21 wherein said polyethylene oxide has a particle size such that at least 90% wt. of the polyethylene oxide is above about 10 microns.

23. The metallurgical powder composition of claim 22 wherein the weight average particle size of the polyethylene oxide is between about 50 and 150 microns.

24. The metallurgical powder composition of claim 23 wherein the polyethylene oxide has a particle size distribution such that at least 90% by weight of the polyethylene oxide has a particle size below about 150 microns.

* * * * *